US009243781B2

(12) United States Patent
Chen

(10) Patent No.: US 9,243,781 B2
(45) Date of Patent: Jan. 26, 2016

(54) LIGHT EMITTING DIODE LIGHT SOURCE MODULE HAVING UNIFORM ILLUMINATION

(71) Applicant: HON HAI PRECISION INDUSTRY CO., LTD., New Taipei (TW)

(72) Inventor: Po-Chou Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 201 days.

(21) Appl. No.: 14/103,859

(22) Filed: Dec. 12, 2013

(65) Prior Publication Data

US 2015/0098226 A1 Apr. 9, 2015

(30) Foreign Application Priority Data

Oct. 8, 2013 (TW) ..... 102136300 A

(51) Int. Cl.
*F21V 13/04* (2006.01)
*F21K 99/00* (2010.01)
*F21Y 101/02* (2006.01)

(52) U.S. Cl.
CPC . *F21V 13/04* (2013.01); *F21K 9/50* (2013.01); *F21Y 2101/02* (2013.01)

(58) Field of Classification Search
CPC ..... F21K 9/50; F21K 9/52; F21K 9/54; F21K 9/135; F21V 13/04
USPC ..... 362/97.3, 606; 349/65
See application file for complete search history.

(56) References Cited

U.S. PATENT DOCUMENTS 5,335,157 A * 8/1994 Lyons ..... B60Q 1/2611 362/297
6,547,423 B2 * 4/2003 Marshall ..... F21V 5/04 257/E33.072
7,349,163 B2 * 3/2008 Angelini ..... F21K 9/00 257/99
8,556,445 B2 * 10/2013 Kamada ..... G02F 1/133603 349/62
2007/0297179 A1 * 12/2007 Leung ..... F21K 9/50 362/296.07
2015/0009679 A1 * 1/2015 Seki ..... G02B 7/022 362/307
2015/0043217 A1 * 2/2015 Hu ..... F21K 9/50 362/308

* cited by examiner

*Primary Examiner* — Karabi Guharay
(74) *Attorney, Agent, or Firm* — Novak Druce Connolly Bove + Quigg LLP

(57) ABSTRACT

An LED light source module includes a base, an LED light source positioned on the base, an optical lens located on the light path of the LED light source and a diffusion plate positioned above the optical lens. An upper surface of the base is a light reflective surface. The optical lens defines a through hole aligned with the LED light source. A reflecting body is protruded from the diffusion plate toward the through hole of the optical lens. When the light emitted from the LED light source is projected to the reflecting surface of the light reflecting body through the through hole, the light is reflected by the reflecting surface to reach the upper surface of the base, and then is reflected by the upper surface of the base to reach the diffusion plate.

13 Claims, 1 Drawing Sheet

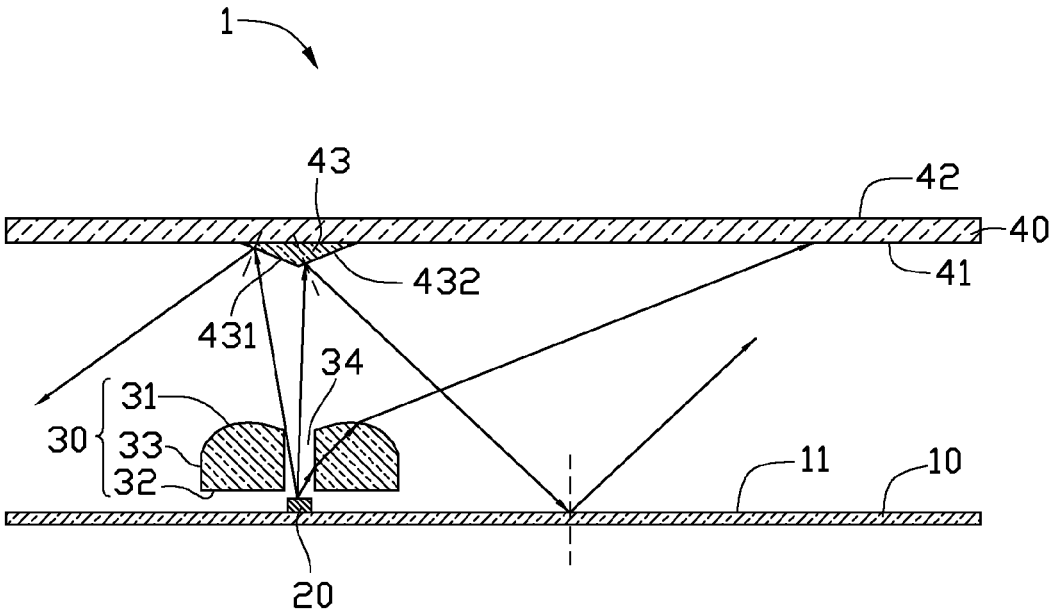
1
43
42
40
432
41
431
34
31
30
33
32
11
10
20

LIGHT EMITTING DIODE LIGHT SOURCE MODULE HAVING UNIFORM ILLUMINATION

BACKGROUND

1. Technical Field

The present disclosure relates to light source modules, and more particularly to an LED (light emitting diode) light source module having a uniform distribution of light output, whereby the LED light source module is suitable for illuminating a planar display, for example, a liquid crystal display (LCD) or a sign box.

2. Description of Related Art

LEDs have been widely promoted as light sources of electronic devices owing to many advantages, such as high luminosity, low operational voltage and low power consumption. A traditional LED light source module commonly includes an LED light source and an optical lens covering the LED light source. However, the light intensity at the right top of the LED light source module is stronger than that of the peripheral area of the LED light source module, thereby causing the light field of the LED light source module to be not uniform.

Therefore, an LED light source module which is capable of overcoming the above described shortcomings is desired.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

The only drawing FIGURE shows a cross sectional view of an LED light source module in accordance with an embodiment of the present disclosure.

DETAILED DESCRIPTION

Referring to the only drawing FIGURE, an LED light source module 1 in accordance with an embodiment of the present disclosure includes a base 10, an LED light source 20 located on the base 10, an optical lens 30 located on a light path of the LED light source 20 and a diffusion plate 40 located above the optical lens 30. The LED light source module 1 is a planar light source which is used to illuminate a planar display device such a liquid crystal display (LCD) or a sign box.

The base 10 is a thin plate, and includes an upper surface 11. The upper surface 11 is reflective and can reflect light impinging thereon, whereby the light which impinges on the upper surface 11 can be reflected by the upper surface 11 to project upwardly to an area above the upper surface 11. In this embodiment, the upper surface 11 can be a smooth flat surface or an uneven surface.

The LED light source 20 is located on the upper surface 11 of the base 10, and electrically connected with the base 10. In this embodiment, the LED light source 20 is an LED package, and a light output surface of the LED light source 20 remotes from the base 10.

The optical lens 30 is located over the right top of the LED light source 20, and spaced from the LED light source 20. The optical lens 30 includes a top surface 31, a bottom surface 32 opposite to the top surface 31 and a lateral surface 33 connecting the top surface 31 and the bottom surface 32. The top surface 31 faces the diffusion plate 40, and the bottom surface 32 faces the LED light source 20. The optical lens 30 defines a through hole 34, and the through hole 34 penetrates through a middle of the optical lens 30 from the top surface 31 to the bottom surface 32 of the optical lens 30. In this embodiment, the top surface 31 is a curved surface, the bottom surface 32 is a flat surface, and the lateral surface 33 is perpendicular to the bottom surface 32. The through hole 34 right faces the light output surface of the LED light source 20, and a bore size of the through hole 34 is greater than a width of the LED light source 20.

The diffusion plate 40 is a thin plate, and includes a light input surface 41 and a light output surface 42 opposite to the light input surface 41. A reflecting body 43 is protruded from the light input surface 41 of the diffusion plate 40 toward the through hole 34 of the optical lens 30. In this embodiment, a projecting area of the reflecting body 43 on the optical lens 30 is greater than an area of a traversal cross-section of the through hole 34. A longitudinal cross-section of the reflecting body 43 is triangular. The reflecting body 43 includes a first reflecting surface 431 on the left side and a second reflecting surface 432 on the right side, and the first reflecting surface 431 and the second reflecting surface 432 both face the through hole 34. The first and second reflecting surfaces 431, 432 are flat surfaces and inclined relative to the diffusion plate 40 and intersect each other at a point which is aligned with a center of the LED light source 20 and a center of the through hole 34. The first reflecting surface 431 and the second reflecting surface 432 are reflective and can reflect light impinging thereon. The light impinging on the first reflecting surface 431 is reflected thereby toward the left area of the upper surface 11 of the base 10, and the light impinging on the second reflecting surface 432 is reflected thereby toward the right area of the upper surface 11 of the base 10. In another embodiment, the first reflecting surface 431 and the second reflecting surface 432 can be cambered surfaces.

During operation of the LED light source 20, one part of the light emitted from the LED light source 20 runs through the through hole 34 of the optical lens 30, and travels toward the first reflecting surface 431 and the second reflecting surface 432 of the diffusion plate 40, and is reflected thereby toward the upper surface 11 of the base 10. This part of light is then reflected by the base 10 toward the light input surface 41 of the diffusion plate 40, and finally outputs to external environment from the light output surface 42. The other part of the light travels toward an interior of the optical lens 30, and is refracted by the optical lens 30 toward the light input surface 41 of the diffusion plate 40, finally outputs to external environment from the light output surface 42.

Therefore, the light intensity at the right top of the LED light source module 1 is weaker, and the light intensity of the peripheral area is stronger, whereby the light output of the LED light source module 1 is more uniform.

The LED light source module 1 can be used as a backlight module or a lamp, and the light output of the backlight module or the lamp is more uniform.

Particular embodiments are shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. An LED (light emitting diode) light source module, comprising:

a base;

an LED light source positioned on the base;

an optical lens located at a light path of the LED light source; and a diffusion plate located above the optical lens;

wherein an upper surface of the base is light reflective which reflects light impinging thereon, the optical lens defines a through hole aligned with the LED light source, a reflecting body is protruded from the diffusion plate toward the through hole of the optical lens, the reflecting body has a reflecting surface facing the through hole, light emitted from the LED light source and projected through the through hole is radiated to the reflecting surface of the reflecting body and is reflected thereby to reach the upper surface of the base, and then is reflected by the upper surface of the base to reach the diffusion plate.

2. The LED light source module of claim 1, wherein a bore size of the through hole is greater than a width of the LED light source.

3. The LED light source module of claim 1, wherein a projecting area of the reflecting body on the optical lens is greater than an area of a traversal cross-section of the through hole.

4. The LED light source module of claim 1, wherein a longitudinal cross-section of the reflecting body is triangular, and the reflecting surface of the reflecting body comprises a first reflecting surface and a second reflecting surface facing the through hole.

5. The LED light source module of claim 4, wherein the first reflecting surface and the second reflecting surface are both inclined flat surfaces related to the diffusion plate.

6. The LED light source module of claim 5, wherein the first reflecting surface and the second reflecting surface intersect at a point which is aligned with a center of the LED light source and a center of the through hole.

7. The LED light source module of claim 1, wherein the optical lens comprises a top surface and a bottom surface opposite to the top surface, the top surface faces the diffusion plate, the bottom surface faces the LED light source, the through hole penetrates through a middle of optical lens from the top surface to the bottom surface of the optical lens.

8. An LED (light emitting diode) light source module, comprising:

a base;

an LED light source located on the base;

an optical lens located at a light path of the LED light source, the optical lens comprising a top surface and a bottom surface opposite to the top surface, the top surface facing the diffusion plate, the bottom surface facing the LED light source; and a diffusion plate located above the optical lens;

wherein an upper surface of the base light is reflective, the optical lens defines a through hole corresponding to the LED light source, the through hole penetrates through a middle of the optical lens from the top surface and the bottom surface of the optical lens, a reflecting body is protruded from the diffusion plate toward the through hole of the optical lens, and the reflecting body has a first reflecting surface and a second reflecting surface forming an included angle therebetween and facing the through hole, wherein the light emitted from the LED light source and through the through hole is projected to the first reflecting surface and the second reflecting surface of the reflecting body, the light is reflected by the first and second reflecting surfaces to reach the upper surface of the base, and then is reflected thereby to reach the diffusion plate.

9. The LED light source module of claim 8, wherein a bore diameter of the through hole is greater than a width of the LED light source.

10. The LED light source module of claim 8, wherein a projecting area of the reflecting body on the optical lens is greater than an area of a traversal cross-section of the through hole.

11. The LED light source module of claim 8, wherein a longitudinal cross-section of the reflecting body is triangle.

12. The LED light source module of claim 11, wherein the first reflecting surface and the second reflecting surface are both inclined flat surfaces related to the diffusion plate.

13. The LED light source module of claim 12, wherein the first reflecting surface and the second reflecting surface intersect each other at a point which is aligned with a center of the LED light source and a center of the through hole.

* * * * *